US007292707B2

(12) United States Patent
Kreitmeier et al.

(10) Patent No.: US 7,292,707 B2
(45) Date of Patent: Nov. 6, 2007

(54) LOUDSPEAKER

(75) Inventors: Leohard Kreitmeier, Bogen (DE); Jürgen Ringlstetter, Straubing (DE)

(73) Assignee: Harman Becker Automotive Systems GmbH, Karlsbad (DE)

( * ) Notice: Subject to any disclaimer, the term of this patent is extended or adjusted under 35 U.S.C. 154(b) by 224 days.

(21) Appl. No.: 10/475,078

(22) PCT Filed: Apr. 11, 2002

(86) PCT No.: PCT/EP02/04054

§ 371 (c)(1),
(2), (4) Date: Mar. 29, 2004

(87) PCT Pub. No.: WO02/089522

PCT Pub. Date: Nov. 7, 2002

(65) Prior Publication Data

US 2004/0165746 A1 Aug. 26, 2004

(30) Foreign Application Priority Data

Apr. 25, 2001 (DE) ..... 101 20 281

(51) Int. Cl.
*H04R 25/00* (2006.01)

(52) U.S. Cl. ..... 381/398; 381/396; 381/404

(58) Field of Classification Search ..... 381/396, 381/398, 404, 407, 423–426, 431–433; 181/171–174
See application file for complete search history.

(56) References Cited

U.S. PATENT DOCUMENTS 4,680,800 A * 7/1987 Bank et al. ..... 381/404
5,014,323 A * 5/1991 Markow et al. ..... 381/404
5,619,019 A 4/1997 Yoshimura et al. ..... 181/166
5,903,656 A * 5/1999 D'Hoogh et al. ..... 381/404
6,069,965 A 5/2000 Takewa et al. ..... 381/404
6,118,884 A * 9/2000 Proni ..... 381/404
6,173,065 B1 * 1/2001 Lin ..... 381/404
6,385,327 B1 * 5/2002 D'Hoogh ..... 381/404

FOREIGN PATENT DOCUMENTS

| | | |
|---|---|---|
| DE | 1 001 326 | 1/1957 |
| DE | 197 47 955 | 5/1999 |
| DE | 198 40 374 | 3/2000 |
| EP | 0 914 020 | 5/1999 |

* cited by examiner

*Primary Examiner*—Suhan Ni
(74) *Attorney, Agent, or Firm*—O'Shea, Getz & Kosakowski, P.C.

(57) ABSTRACT

A loudspeaker has a diaphragm with an edge area and a central area. A voice coil carrier may be fastened to the diaphragm in the central area, a voice coil being wound around the voice coil carrier. A magnet system may be included into which the voice coil carrier and the voice coil are completely or partially inserted. A basket may enclose one face of the diaphragm and to which the magnet system is fastened. An elastic bead may be fastened to the edge area of the diaphragm and to the basket. A centering device may be fastened to the central area of the diaphragm and to the basket. The loudspeaker may include an additional elastic bead as a centering device, which is fastened directly or indirectly to the basket and the diaphragm.

20 Claims, 5 Drawing Sheets

LOUDSPEAKER

PRIORITY INFORMATION

This patent application claims priority from International patent application PCT/EP2002/004054 filed Apr. 11, 2002 and German patent application 101 20 281.4 filed Apr. 25, 2001, which are both hereby incorporated by reference.

BACKGROUND OF THE INVENTION

This invention relates in general to a loudspeaker and in particular to a loudspeaker having a centering device.

A loudspeaker has a diaphragm with an edge area and a central area. A voice coil carrier is fastened to the diaphragm in the central area, a voice coil being wound around the voice coil carrier. A magnet system is included into which the voice coil carrier and the voice coil are completely or partially inserted. A basket encloses one face of the diaphragm and to which the magnet system is fastened. An elastic bead is fastened to the edge area of the diaphragm and to the basket. A centering device is fastened to the central area of the diaphragm and to the basket.

Such a loudspeaker is disclosed, for example, by Ivar Veit, Technische Akustik [Industrial Acoustics], second edition 1978, page 91, where a centering spider fastened to the basket and diaphragm is provided as a centering device. The current in the voice coil and the magnetic field in the air gap of the magnet system interact with one another in such a way that Lorentz forces occur in the direction of the axis of symmetry. This converts the input voltage on the voice coil into a mechanical motion of the voice coil and accordingly of the diaphragm. The suspension of the oscillating system comprising the bead and the centering spider then generates return forces and holds in position the voice coil, which is connected to the radiating diaphragm. Damping then occurs in this oscillating overall system from a suspension comprising electrically the magnet system and mechanically the bead and the centering spider.

Since the magnetic force and hence the electrical damping are not constant in the operating area of the loudspeaker in standard loudspeakers, there is a resultant excursion-dependent overall damping that becomes weaker at large excursions. Designs that avoid this are in general large and uneconomical to manufacture because of the large winding widths and strong magnets needed.

For this reason it is necessary to increase the mechanical damping, which results in the variation of the overall damping becoming smaller. Also, the material and mode of motion of the centering spider cause it to contribute an insignificant component to the overall damping, in particular because of flexing in the edge area and stretching in the principal area.

What is needed is a loudspeaker with increased mechanical damping.

SUMMARY OF THE INVENTION

A loudspeaker has a diaphragm with an edge area and a central area. A voice coil carrier may be fastened to the diaphragm in the central area, a voice coil being wound around the voice coil carrier. A magnet system may be included into which the voice coil carrier and the voice coil are completely or partially inserted. A basket may enclose one face of the diaphragm and to which the magnet system is fastened. An elastic bead may be fastened to the edge area of the diaphragm and to the basket. A centering device may be fastened to the central area of the diaphragm and to the basket. The loudspeaker may include an additional elastic bead as a centering device, which is fastened directly or indirectly to the basket and the diaphragm.

At least one of the two beads may be made of foam or rubber. The parameters that produce the desired damping in the case of foam beads for example are the type of material, the density, and the thickness of the bead. For rubber beads, the parameters include the type of material, thickness, and Shore hardness. The additional bead may be fastened directly or indirectly to the diaphragm and/or the basket by a bead mount. The bead mount can be provided by any structure, for example an injection-molded part, a honeycomb structure, a diaphragm, or another shaped part.

A support structure can be disposed between the diaphragm and the additional bead and can be connected directly or indirectly to both. Such filling or supporting structures serve to stiffen the overall diaphragm or subregions of the diaphragm to suppress certain modes. Such a support structure, for example, can also be placed between the diaphragm and the bead mount and can be connected directly or indirectly thereto. The support structure may comprise, for example, a honeycomb material, a foamed material, or a diaphragm material.

The support structure may be used for example in loudspeakers whose diaphragm is of essentially flat design. There, the support structure and/or the bead mount equalize the distance of the two beads from one another in the direction of the oscillation of the diaphragm. An inverse cone diaphragm may be used as the support structure.

Besides the one additional bead, a second additional bead can also be provided that is fastened directly or indirectly to the diaphragm and the basket. The additional bead may have a semicircular bend and a flat area, with the thickness of the bead being smaller in the area of the bend than in the flat area. The support structure can also be designed as a bead mount.

The magnet system can be placed on the side of the basket facing the diaphragm, which results in a relatively compact structure, in particular for a flat loudspeaker.

An advantage is that relatively high mechanical damping is produced at a relatively low cost. Also, a desired damping range can be produced by readily implemented variations in material and design.

These and other objects, features and advantages of the present invention will become more apparent in light of the following detailed description of preferred embodiments thereof, as illustrated in the accompanying drawings.

DETAILED DESCRIPTION OF THE INVENTION

Figure 1:
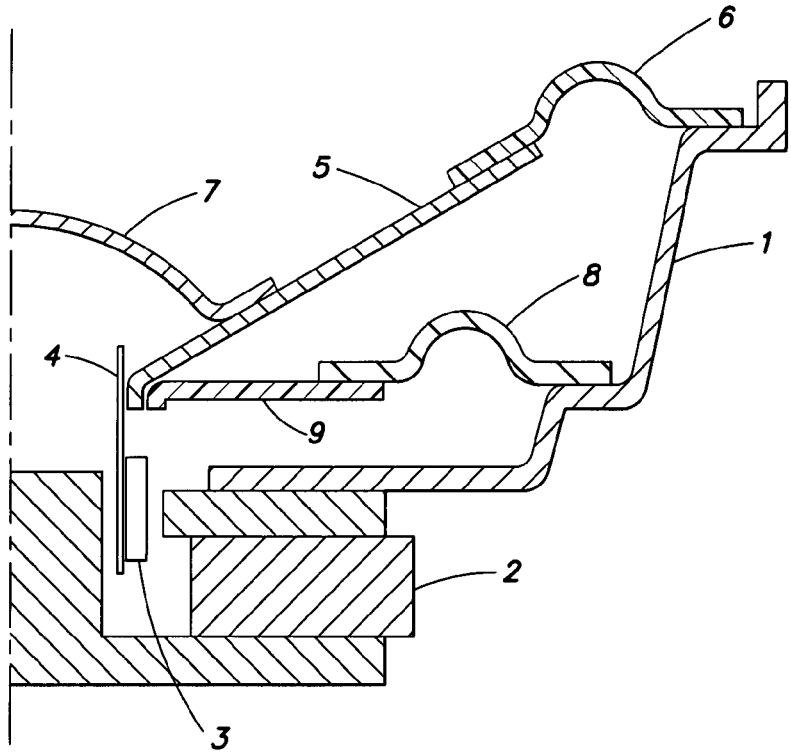
FIG. 1 is a cross-sectional view of a loudspeaker.

Referring to FIG. 1, a loudspeaker includes a funnel-shaped basket 1 as a supporting element. An opening is made at least in the central area, and to which is fastened a cup-shaped magnet system 2. At a central opening in the basket 1 is placed a voice coil 3 that is movable axially through the opening in the basket 1 into which the magnet system 2 is inserted. The voice coil 3 is wound around a voice coil carrier 4 fastened to a diaphragm 5. The diaphragm 5 is fastened by a bead 6 to the outer area of the basket 1 with the capability of vibrating. To protect the drive system consisting of the magnet system 2 and the voice coil 3 against penetrating dust, there is a dust guard dome 7 located in the area of the connection of the voice coil carrier 4 and the diaphragm 5.

Another bead 8 may be provided as a centering device. The bead 8 is fastened at one end to a corresponding projection of the basket 1 and is connected at the other end through an intermediate bead mount 9 to the central area of the diaphragm 5. The bead mount 9 may be eliminated. However, if the two beads 6 and 8 are somewhat similar in size, the bead mount 9 may be necessary. Since in contrast to the known centering diaphragm a bead is not so extended, the bead mount 9 also serves to equalize the distance between the additional bead 8 and the diaphragm 5. The bead mount 9 can be made of any material and in any shape as long as it meets the space requirements and is as light as possible. Therefore, a plastic molded part or an additional conforming diaphragm may be provided for example as the bead mount 9.

Figure 2:
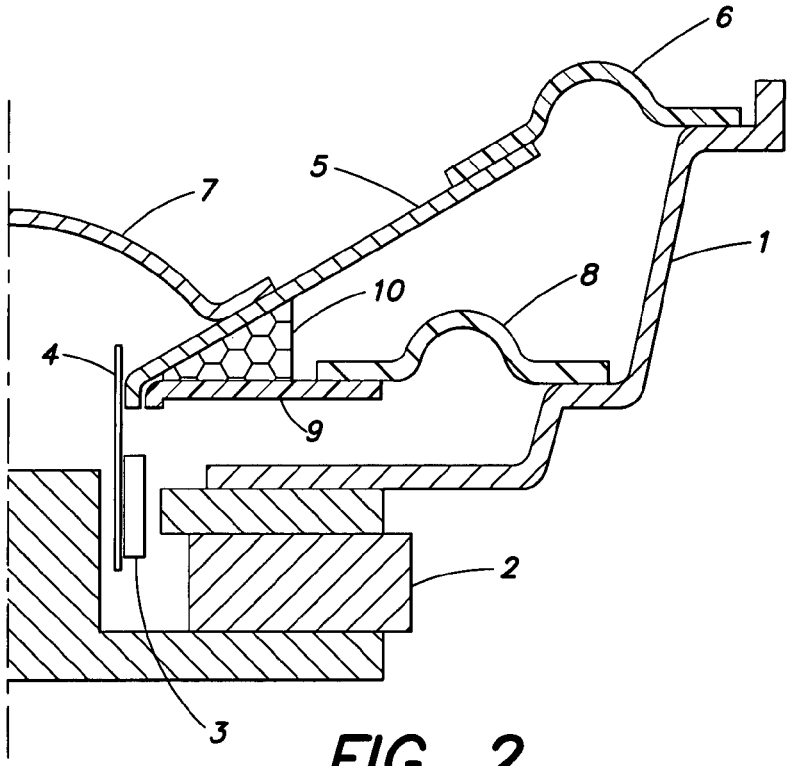
FIG. 2 is a cross-sectional view of the loudspeaker of FIG. 1 with an additional support structure.

Referring to FIG. 2, the loudspeaker illustrated there is similar to that of FIG. 1. The loudspeaker of FIG. 2 includes an additional support structure 10. The support structure 10 may be wedge-shaped and may be placed in the angle between the diaphragm 5 and the bead mount 9. The support structure 10 tapers to a point at the seam between the diaphragm 5 and the bead mount 9 and, for example, is cemented firmly thereto. The support structure 10, for example, can also be located in the area of the loudspeaker at which the movable parts of the centering diaphragm were located in the prior art. The support structure 10 may, for example, comprise a honeycomb structure or a foamed part.

Figure 3:
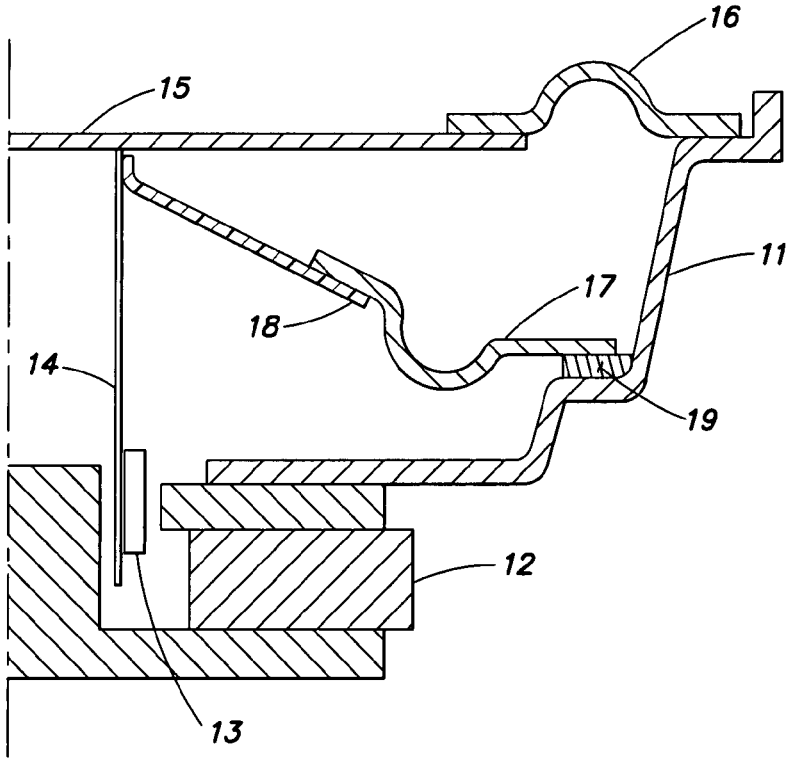
FIG. 3 is a cross-sectional view of a loudspeaker with a flat diaphragm.

Referring to FIG. 3, a loudspeaker includes a basket 11 with an opening at the central point that is closed off toward the outside by a cup-shaped magnet system 12. A voice coil 13 wound on a voice coil carrier 14 is inserted into the magnet system 12 through the opening in the basket 11. The voice coil carrier 14 is joined essentially at a right angle to a flat diaphragm 15, which in turn is firmly connected to a bead 16. The bead 16 is fastened at its edge away from the flat diaphragm 15 to the outer rim area of the basket 11.

Another bead 17 may be provided as a centering device. The bead 17 may be fastened to the seam between the voice coil carrier 14 and the flat diaphragm 15 by a bead mount 18, and through a spacer 19 to the basket 11. When used in a flat diaphragm loudspeaker, the bead mount 18 is designed so that the required height spacing between the two oscillating-system mounts (beads) is adhered to. The bead mount 18 may comprise an inverse cone diaphragm.

Figure 4:
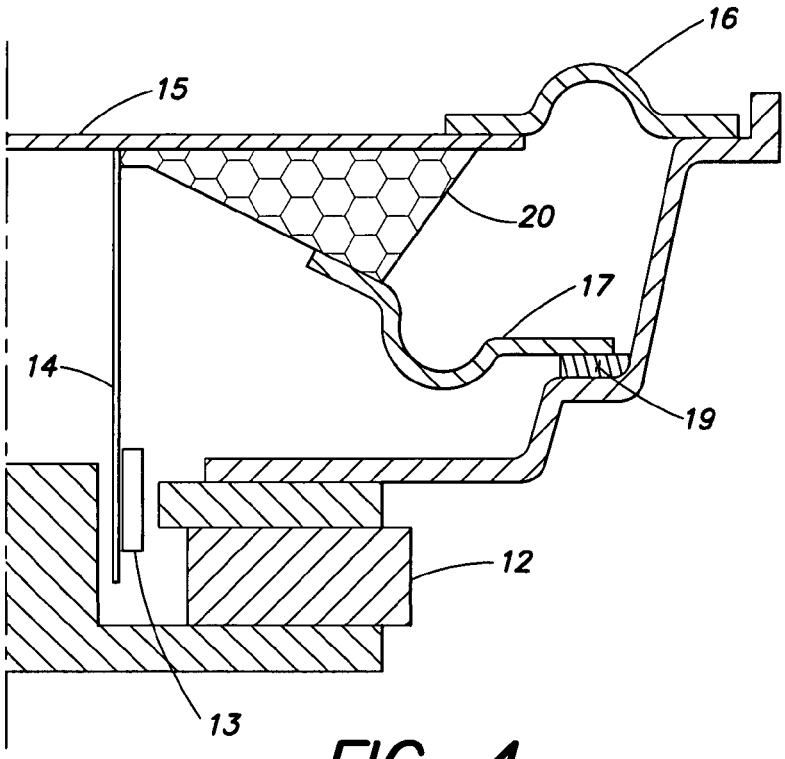
FIG. 4 is a cross-sectional view of the loudspeaker of FIG. 3 with an additional support structure.

Referring to FIG. 4, a wedge-shaped support structure 20 may be provided instead of the bead mount 18 of FIG. 3. The support structure 20 holds the bead 17, so that a bead mount is inherently formed. To this end, for example, the bead 17 is cemented to the support structure 20, which in turn is fastened by cementing to the bottom of the flat diaphragm 15, for example. The additional bead 17 may be bent opposite to the bead 16. The beads can be designed normally or inverted.

Figure 5:
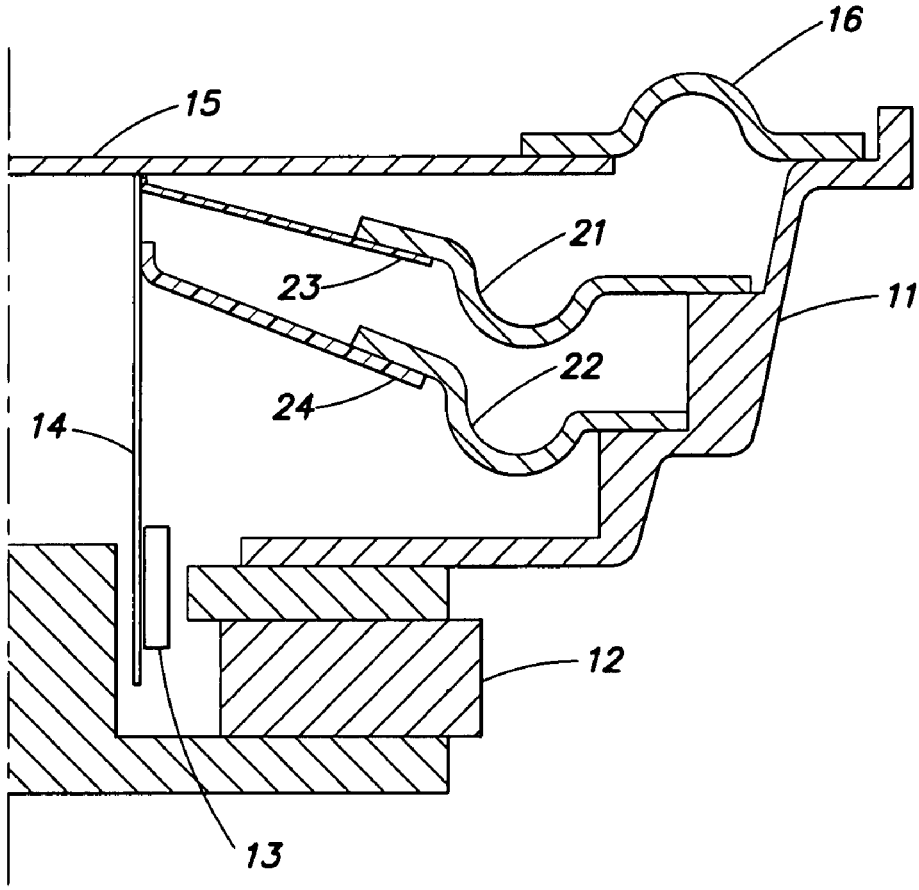
FIG. 5 is a cross-sectional view of a loudspeaker with multiple beads.

Referring to FIG. 5, a multiple bead design may be used as a centering device. The basket 11 in this case has two internal steps for fastening two additional beads 21 and 22. The bead 21, which is placed closer to the flat diaphragm 15, is connected to the outer end of a bead mount 23, which in turn is fastened to the voice coil carrier 14 in the area of the seam between the carrier 14 and the flat diaphragm 15. On the other hand, somewhat farther away from the flat diaphragm 15, the bead 22 is connected to one end of a bead mount 24, which is likewise fastened to the voice coil carrier 14 in the area of the bead mount 23.

Depending on the particular materials used, the fastening can be accomplished in different ways, for example by cementing, welding, or soldering. Furthermore, instead of the step-like design of the basket 11, the two ends of the additional beads 21 and 22 facing the basket 11 can also be separated from one another by an appropriate spacer profile. The inclusion of an additional bead in the function of the centering device increases the available mechanical damping. Thus, the mechanical damping of the overall oscillating system can be further increased by including additional bead suspensions. The number of additional beads depends in particular on the necessary magnitude of the oscillating mass and the efficiency resulting therefrom.

Figure 6:
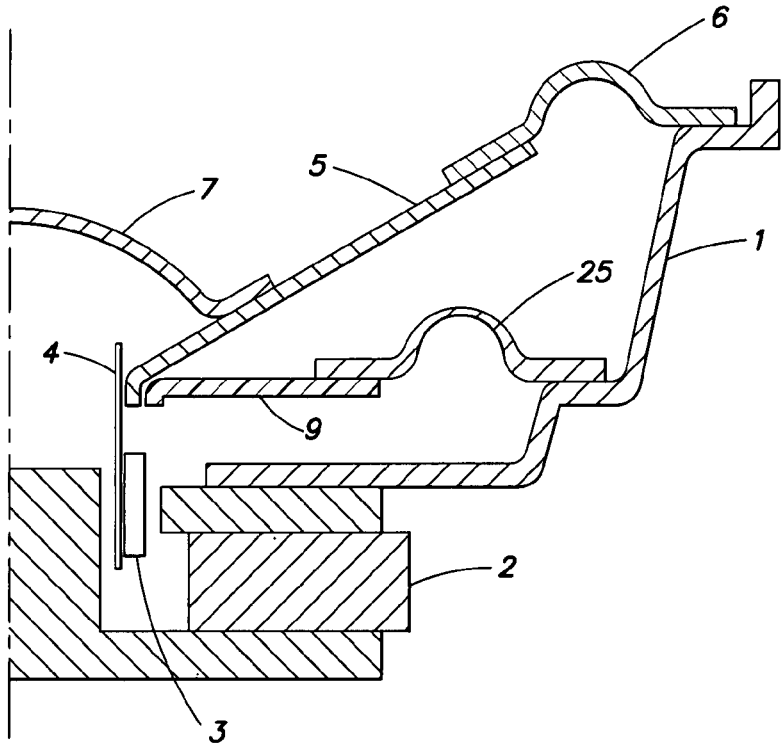
FIG. 6 is a cross-sectional view of a loudspeaker with a bead having a particular shape.
Figure 7A:
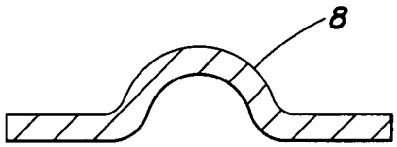
FIGS. 7A and 7B are cross-sectional views of two different beads of the loudspeakers of FIGS. 1 and 6, respectively.
Figure 7B:
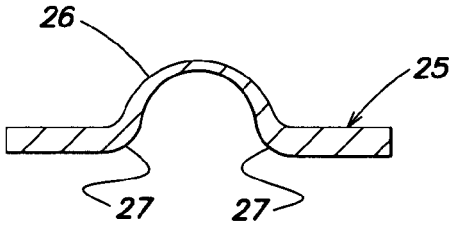

Referring to FIG. 6, the loudspeaker is similar to that of FIG. 1 except that a bead 25 with a particular design is used instead of the bead 8 of FIG. 1. FIGS. 7A and 7B compare the two beads 8 and 25 with one another. The bead 8 of FIG. 7A has constant thickness over the entire radial extent, i.e. a constant vertical extent in the radial direction. On the other hand, the modified bead 25 of FIG. 7B is tapered down in the area of the central bend 26 and is thickened in the transitional regions 27 from the central bend to the edge areas. If the bead and/or the bead design that performs the centering function is specially shaped geometrically (as illustrated in FIG. 7B, for example), then both the damping curve and the stiffness can be modulated and optimized across the diaphragm excursion.

Figure 8:
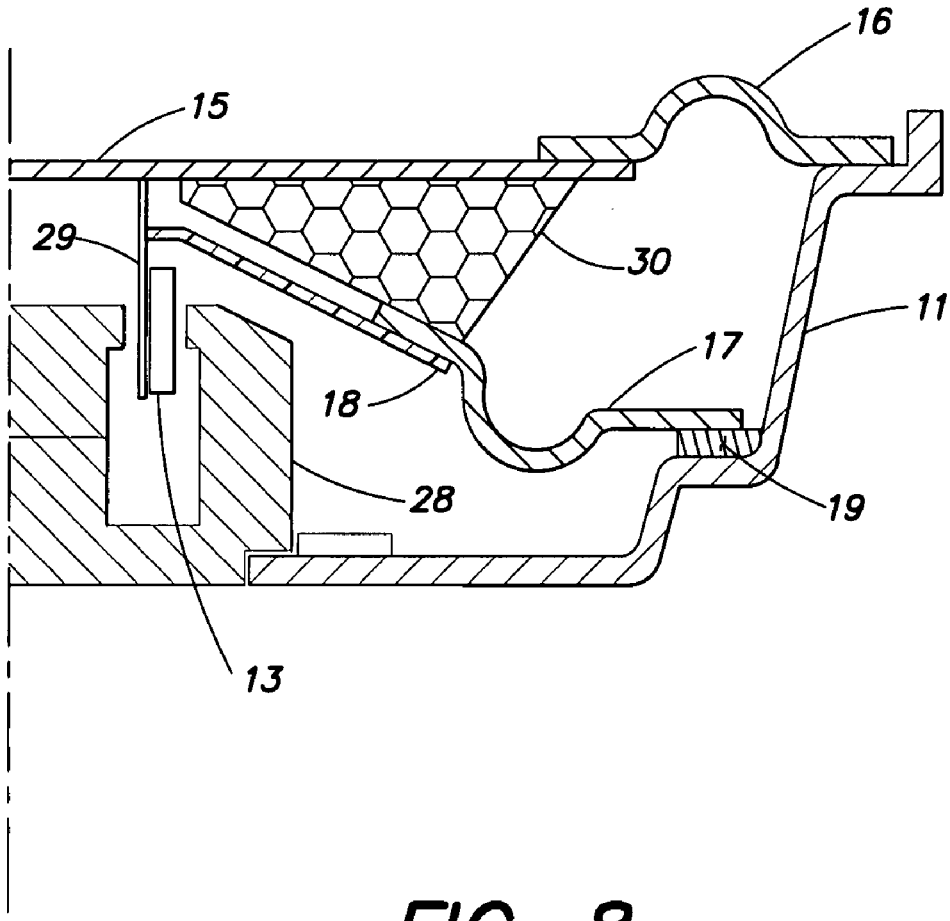
FIG. 8 is a cross-sectional view of a loudspeaker with a raised magnet system.

Referring to FIG. 8, the loudspeaker is similar to that of FIG. 3. The primary difference is that instead of the magnet system 12, a magnet system 28 may be used that is not behind the basket 11 viewed from the flat diaphragm 15, as illustrated in FIG. 3, but is in front of the basket 11, toward the flat diaphragm 15. Corresponding to this, a shorter voice coil carrier 29 may be used in the loudspeaker of FIG. 8 instead of the voice coil carrier 14 of the loudspeaker of FIG. 3.

In addition, a support structure 30 may be provided that has a wedge-shaped design. The support structure 30 is introduced in the angle formed by the flat diaphragm 15 and the bead mount 18 by joining it to the flat diaphragm 15 over its entire surface, for example by cementing, and joining it to the section of the additional bead 17 also fastened to the bead mount 18, on its opposite face, for example by cementing. Depending on the particular case, the bead mount 18 can also be omitted and the support structure 30 can be used as the bead mount.

In particular, by using an NdFe cup magnet system or an appropriate magnet system with small dimensions, the structural depth of the loudspeaker can be reduced by raising this magnet system without affecting its excursion capability.

Although the present invention has been shown and described with respect to several preferred embodiments thereof, various changes, omissions and additions to the form and detail thereof, may be made therein, without departing from the spirit and scope of the invention.

What is claimed is:

1. A loudspeaker, comprising:

a diaphragm having an edge area and a central area;

a voice coil carrier connected to the diaphragm;

a voice coil wound around the voice coil carrier;

a magnet system into which the voice coil carrier and the voice coil are at least partially inserted;

a basket that encloses one face of the diaphragm and to which the magnet system is connected;

a first suspension connected to the diaphragm and the basket;

a second suspension separate from the first suspension, where the second suspension is connected to the basket and the second suspension comprises a non-uniform thickness; and a mount that connects the second suspension to the diaphragm, where the mount comprises a circular disk.

2. The loudspeaker of claim 1, further comprising a support structure disposed between and connected with the diaphragm and the second suspension.

3. The loudspeaker of claim 2, where the support structure has a thickness that spans a distance between the second suspension and the diaphragm.

4. The loudspeaker of claim 2, where the support structure comprises a honeycomb material.

5. The loudspeaker of claim 2, where the support structure comprises a foamed material.

6. The loudspeaker of claim 1, and wherein the second suspension comprises first and second end regions joined by a hemispherical central region, where the hemispherical central has a thickness less than the first and second end regions.

7. The loudspeaker of claim 1, where the diaphragm is flat and the mount equalizes a distance between the first suspension and the second suspension in the direction of oscillation of the diaphragm.

8. The loudspeaker of claim 2, where the support structure comprises an inverse cone diaphragm.

9. The loudspeaker of claim 1, further comprising a third suspension connected with the diaphragm and the basket.

10. The loudspeaker of claim 1, where the second suspension has a semicircular bend and a flat area, with the thickness of the second suspension being smaller in the area of the bend than in the flat area.

11. The loudspeaker of claim 9, where the third suspension is directly connected to the diaphragm by a mount.

12. The loudspeaker of claim 1, where the magnet system is disposed on a face of the basket facing the diaphragm.

13. A loudspeaker, comprising:

a diaphragm having an edge area and a central area;

a voice coil carrier connected to the diaphragm;

a voice coil wound around the voice coil carrier;

a magnet system into which the voice coil carrier and the voice coil are at least partially inserted;

a basket that encloses one face of the diaphragm and to which the magnet system is connected;

a first suspension connected to the diaphragm and the basket;

a second suspension separate from the first suspension, where the second suspension is connected to the basket and the second suspension comprises a non-uniform thickness; and a support structure that connects the second suspension to the diaphragm, the support structure having a thickness that spans a distance between the second suspension and the diaphragm.

14. A loudspeaker, comprising:

a diaphragm;

a voice coil carrier connected to the diaphragm;

a voice coil wound around the voice coil carrier;

a magnet system into which the voice coil carrier and the voice coil are at least partially inserted;

a basket that encloses a face of the diaphragm and to which the magnet system is connected;

first and second suspensions each connected to the diaphragm and to the basket, where the second suspension comprises a non-constant thickness; and a mount that connects the second suspension to the diaphragm.

15. The loudspeaker of claim 14, further comprising a support structure disposed between and connected with the diaphragm and the mount.

16. The loudspeaker of claim 14, further comprising a third suspension connected to the diaphragm and to the basket.

17. The loudspeaker of claim 14, and wherein the second suspension comprises first and second end regions joined by a hemispherical central region, where the hemispherical central has a thickness less than the first and second end regions.

18. The loudspeaker of claim 14, where the second suspension has a semicircular bend and a flat area, a thickness of the second suspension being smaller in the area of the bend as compared to a thickness of the second suspension in the flat area.

19. A loudspeaker, comprising:

a diaphragm;

a voice coil carrier connected to the diaphragm;

a voice coil wound around the voice coil carrier;

a magnet system into which the voice coil carrier and the voice coil are at least partially inserted;

a basket that encloses one face of the diaphragm and to which the magnet system is connected;

first and second suspensions each connected to the diaphragm and to the basket, where the second suspension comprises a non-uniform thickness;

a mount that connects the second suspension to the diaphragm, where the mount comprises a circular disk; and a support structure disposed between the diaphragm and the mount.

20. The loudspeaker of claim 19, where the support structure is connected with the diaphragm and the mount, and wherein the second suspension comprises first and second end regions joined by a hemispherical central region, where the hemispherical central region has a thickness less than the first and second end regions.

* * * * *

UNITED STATES PATENT AND TRADEMARK OFFICE

CERTIFICATE OF CORRECTION

PATENT NO. : 7,292,707 B2
APPLICATION NO. : 10/475078
DATED : November 6, 2007
INVENTOR(S) : Kreitmeier et al.

It is certified that error appears in the above-identified patent and that said Letters Patent is hereby corrected as shown below:

Column 5
In the claims, claim 11, line 48, before "connected" delete "directly"

Signed and Sealed this

Fourth Day of March, 2008

JON W. DUDAS
*Director of the United States Patent and Trademark Office*